United States Patent [19]

Baird, III

[11] 4,065,699

[45] Dec. 27, 1977

[54] CATHODE ASSEMBLY FOR TWO-DIMENSIONAL SCANNED GAS DISCHARGE DISPLAY PANEL

[75] Inventor: Albert W. Baird, III, Burlington, Mass.

[73] Assignee: Beckman Instruments, Inc., Fullerton, Calif.

[21] Appl. No.: 761,931

[22] Filed: Jan. 24, 1977

[51] Int. Cl.[2] ..... H05B 37/00

[52] U.S. Cl. ..... 315/169 TV; 315/169 R

[58] Field of Search ..... 315/169 TV, 169 R; 340/324 M

[56] References Cited

U.S. PATENT DOCUMENTS

| | | | |
|---|---|---|---|
| 3,753,041 | 8/1973 | Lustig et al. | 315/169 TV |
| 3,781,599 | 12/1973 | Bonn | 315/169 TV |

*Primary Examiner*—Alfred E. Smith
*Assistant Examiner*—Charles F. Roberts
*Attorney, Agent, or Firm*—Robert J. Steinmeyer; Ferd L. Mehlhoff; Donald A. Streck

[57] ABSTRACT

An improved cathode assembly for a gas discharge display panel is disclosed providing a first series of cathode elements in a first direction and a second series of cathode elements in a second direction. A separate "keep-alive" element and "initiate signal" element are also provided. The keep-alive element maintains a localized source of ionized gas at all times. Upon activation of the initiate signal element, the ionized gas moves from the keep-alive element to the initiate signal element. The first direction elements are then sequentially activated to cause the ionized gas to pass from the initiate signal element sequentially to each of the first direction elements until the selected first direction element has been reached. The second direction elements are then sequentially activated to cause the ionized gas to pass from the selected first direction cathode element to the second direction cathode elements in sequence until the selected second direction element has been reached. As employed in a multi-layer display, when the ionized gas has reached the selected first-second coordinate on the cathode assembly, normal addressing of the anode and/or cathode elements within the gas discharge display panel can be initiated to cause the desired panel illumination to take place. An insulated spacer defining channels is used in the cathode assembly to guide the gas discharge along the desired path, being so shaped as to prevent the ionized gas from moving out of the selected first direction coordinate along the second direction cathode element.

8 Claims, 9 Drawing Figures

FIG. 1a
PRIOR ART
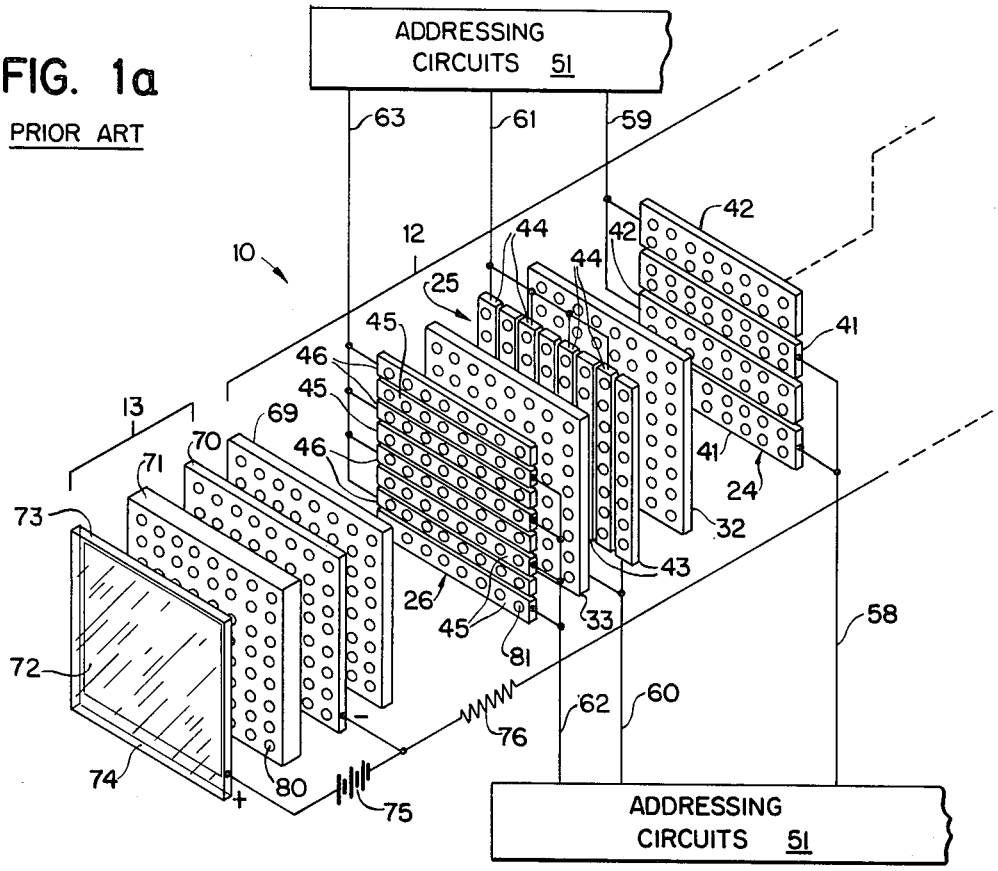
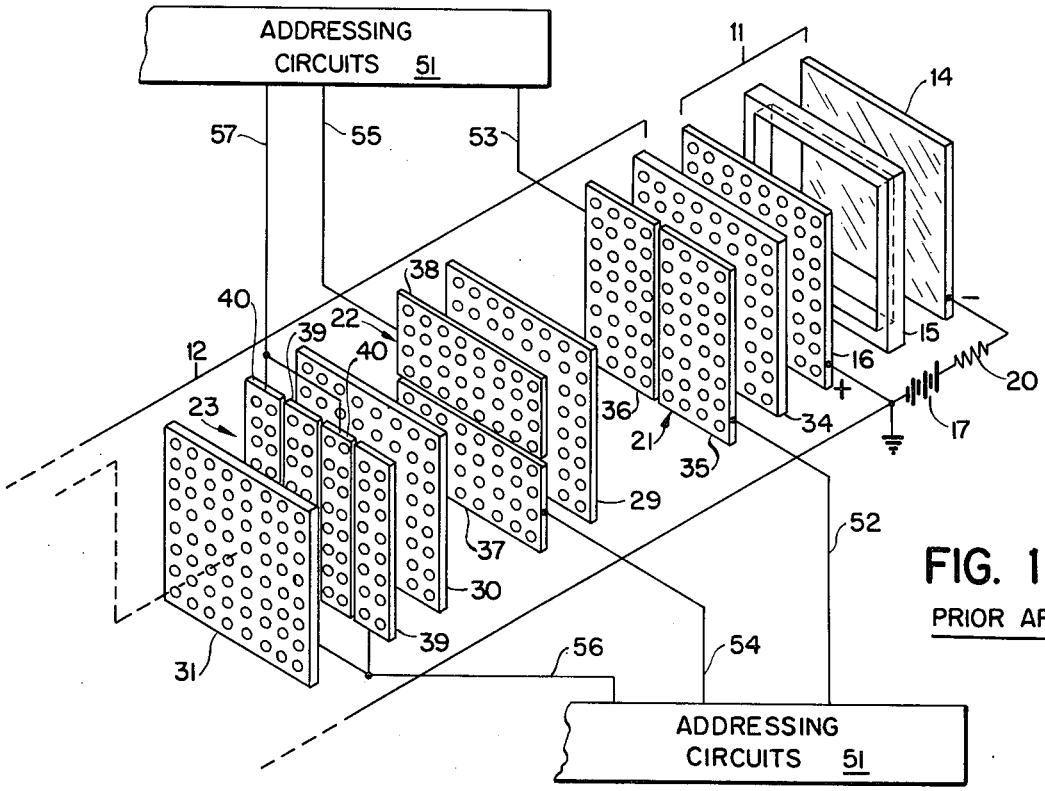
FIG. 1b
PRIOR ART

CATHODE ASSEMBLY FOR TWO-DIMENSIONAL SCANNED GAS DISCHARGE DISPLAY PANEL

BACKGROUND OF THE INVENTION

The present invention relates to display apparatus and more particularly to digitally addressable gas discharge display apparatus.

Digitally addressable gas discharge displays are well known in the art. One form of such apparatus is disclosed by Lustig et al. in their U.S. Pat. No. 3,753,041, and shown in FIGS. 1*a* and 1*b* of the drawings which are part of this application. One such apparatus, generally known as a multi-layer display and indicated as 10, comprises a reservoir 11 for establishing a source of ionized gas, a stack of addressing anode electrodes 12, and a plurality of gas discharge display memory cells 13. The electrically conductive members of the display 10 are comprised of any suitable metal and the electrically isolating members are comprised of any suitable insulating material. The display device 10 is adapted to be filled with a suitable ionizable gas such as, for example, "Penning" mixture comprising 99.5% neon and 0.5% argon.

The reservoir 11 is comprised of a cathode plate 14, an electrically insulating spacer shim 15 and an anode plate 16. With the members 14, 15 and 16 assembled, a reservoir is formed which is adapted to contain a portion of the ionizable gas previously described. A suitable source 17 of ionizing potential is connected, through a discharge stabilizing resistor 20, across the cathode 14 and the anode 16. For reference, the anode 16 is connected, for example, to ground potential. A plurality of apertures are disposed through the anode plate 16 forming a matrix configuration. For purposes of illustration only, an 8 by 8 matrix of 64 apertures is shown.

The stack of addressing anodes 12 is comprised of anode plates 21, 22, 23, 24, 25 and 26, each of which has a plurality of apertures therethrough forming a matrix configuration in a manner similar to that described with respect to the plate 16. The number of addressing anodes required is a function of the number of apertures. Interposed between the addressing anodes 21, 22, 23, 24, 25 and 26, are electrical insulators 29, 30, 31, 32 and 33, respectively, each having a matrix of apertures therethrough in a manner similar to that described with respect to the addressing anodes 21–26. Additionally, an apertured insulating plate 34 is interposed between the anode 16 and the addressing electrode 21. Each of the addressing anodes 21–26 is comprised of two electrically conductive portions electrically isolated from each other as shown, one-half of the apertures of each anode plate are disposed through each of the portions respectively. Other anode configurations and orientations are, of course, also possible.

The portions 35–46 are connected to addressing circuits 51 through leads 52–63 respectively. The addressing circuits 51 comprise conventional circuits for selectively applying either a positive or a negative potential to each of the leads 52–63.

The plurality of gas discharge display memory cells 13 are comprised of a cathode plate 70, an electrically insulating plate 71 and a transparent metal film or perforated metal plate anode 72 disposed on the surface 73 of a transparent insulating cover plate 74. The plates 70 and 71 each have a matrix of apertures therethrough in a manner similar to that described with respect to the plate 16. The anode film (if a film is used) 72 comprises any suitable transparent metal film, such as tin oxide, deposited on the surface 73 of the plate 74. Additionally, an apertured insulating plate 69 is interposed between the addressing anode 26 and the cathode plate 70. The plurality of apertures in the cathode plate 70 and the corresponding plurality of apertures in the insulating plate 71 in combination with the anode film 72 form the plurality of gas discharge cells 13. A suitable source 75 of gas discharge sustaining potential is connected across the memory cathode 70 and the memory anode 72.

The anode plate 16, the addressing electrode plates 21–26, the insulating plates 29–34, the insulating plates 69 and 71, and the cathode plate 70 are superimposed or stacked with respect to each other so that the respective matrices or apertures align to form a plurality of gas conductive channels extending from the reservoir 11 to the plurality of gas discharge memory cells 13, respectively. The plate members 14–16, 21–26, 29–34, 69–71 and 74 are contiguously stacked and sealed at the edges thereof to form a gas tight structure. Alternatively, the plate members forming the structure 10 may be mounted inside a gas tight envelope with electrical connections made through gas tight seals in the envelope.

In operation, the gas contained in the reservoir 11 is ionized by the source of potential 17 thus causing a glowing discharge over the surface area of the cathode 14. The gas discharge sustaining potential is applied across the display cells 13 by the source 75. By suitable application by the addressing circuits 51 of positive and negative potential selectively to the portions of the addressing anodes 21–26, a gas discharge column is extended therethrough in a selected channel to emerge from the selected aperture in the anode 26. Ionized gas particles from the excited gas discharge column enter the associated one of the display cells 13 partially ionizing the gas therein and causing ignition thereof by the voltage applied by the source 75. The source 75 maintains the discharge in the selected cell after the discharge column has been extinguished by the removal of the addressing potentials.

A more detailed operation of the display device 10 of FIG. 1 can be had by reference to the specification of the patent to Lustig et al. cited above.

For the apparatus described above to work properly, the cathode plate 14 must be capable of maintaining a gas discharge layer over the entire surface thereof so as to have ionized gas readily available adjacent each aperture and associated gas conductive channel that may be selected by the addressing circuitry 51. In attempting to adapt the basic apparatus of FIGS. 1*a* and 1*b* to gas discharge display panels of large area, it was found that, contrary to the required operating conditions, a contiguous layer of ionized gas could not be maintained across the total area of cathode plate 14 except with an attendant high power consumption which is unacceptable for most applications. The absence of such ionized gas adjacent the aperture of an addressed gas conductive channel, of course, causes a non-illumination of the portion of the display associated with the channel, which is also unacceptable.

Various solutions have been suggested for providing the required source of ionized gas on a reliable basis with low power consumption in such larger panels. For example, in the U.S. Pat. No. to Bonn (3,781,599), the basic apparatus of FIG. 1*b* has the single cathode plate 14 replaced by a plurality of parallel spaced cathode elements disposed within a serpentine path. By applying a potential to the cathode elements in sequence, the ionized gas is made to jump from one cathode element to the next adjacent cathode element thereby creating a shifting motion of the ionized gas discharge across the face of the cathode assembly. As the column of ionized gas, of an area which can maintain a uniform ionized layer at low power consumption, sweeps across the cathode assembly, the addressing circuits are maintained in timed relation with respect to the shifting signals whereby gas discharge columns can be selectively extended in the channels from the glowing stages of the shifting cathode to the display cells thereby ionizing the gas in the selected display cells. This technique is employed in single layer gas discharge displays as well.

Another solution used in both single and multi-layer panels, the series scanning of the total cathode area in segments is, likewise, hampered by limitations — primarily one of panel address speed. In particular, in a truly "large size" display, the time for serially scanning the total cathode could, conceivably, become a limiting factor. Additionally, the simpler the scanning of the ionized gas reservoir area, the more complex the addressing required to create the desired display. In a truly large display panel the number of addressing anodes, connections thereto, and the attendant addressing logic can also become a limiting factor.

Wherefore, it is the object of the present invention to provide an improved digially addressable gas discharge display apparatus of simple and reliable design capable of use on medium to large multi-layer display panels and also on small to large single layer display panels with low power consumption, minimal external addressing connections and high speed.

SUMMARY

The above objective has been accomplished in the present invention by an improved cathode assembly capable of providing a two dimensional gas discharge scan. A plurality of first cathode elements provide a gas discharge scan in a first direction proceeding from a constant source of ionized gas, maintained by a keep-alive electrode element. A plurality of second cathode elements in conjunction with an insulated spacer having channels extending in a direction generally orthogonal to the second cathode elements provide a gas discharge scan along a selected first direction coordinate in a second direction. Appropriate scan generators are provided to cause the sequential application of ionizing potentials to the aforementioned cathode elements to move an area of ionized gas to the required first and second direction coordinates on the cathode surface.

DESCRIPTION OF THE DRAWINGS

FIG. 1*a* and *b* is an exploded view of a digitally addressable multi-layer gas discharge display panel constructed according to the basic teaching of the prior art.

DESCRIPTION OF THE PREFERRED EMBODIMENT

Figure 2A:
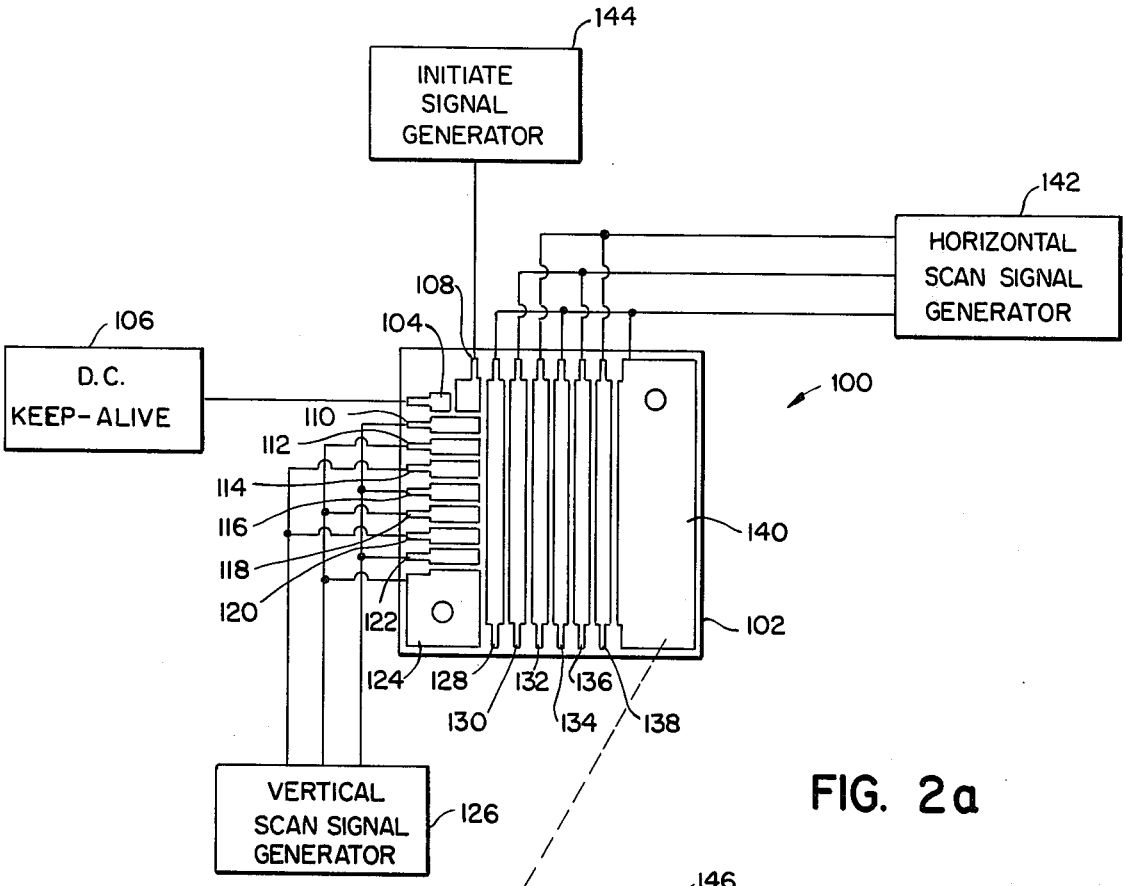
FIG. 2*a, b* and *c* is an exploded view of the elements comprising the improved two-dimensional scanning cathode assembly of the present invention.

The invention to be hereinafter described provides a cathode assembly capable of two dimensional scanned address movement of a gas discharge. The two dimensioned improved scanning cathode assembly in one embodiment, generally indicated as 100, is shown in FIG. 2*a*. Cathode assembly 100 comprises an insulating backing plate 102 having a plurality of cathode elements disposed thereon in a manner to be more fully described. In one top corner of backing plate 102 a keep-alive element 104 is positioned. Keep-alive element 104 is electrically connected to a source of electrical potential 106 sufficient to initially ionize and subsequently keep an ionizable gas adjacent keep-alive element 104 constantly in an ionized state. All electrical potentials used in conjunction with cathode assembly 100 are chosen such that if a potential is simultaneously applied to a particular group of cathode elements relative to a parallel spaced anode, it will ionize the gas adjacent only one element. A constant current source is employed such that upon ionization at the first element, the voltage appearing across the space between the remaining elements and the anode will be insufficient to ionize the gas. When such a potential is applied to a group of cathode elements and the next adjacent cathode element to one of the elements of the group has an ionized layer of gas adjacent thereto, the ionized gas will be caused to cross the gap between the two electrode elements and, in conjunction with the potential to the anode at the element containing unionized gas adjacent thereto, cause that unionized gas to become the first ionized. Thus, by sequentially applying and removing the aforementioned electrical potential to groups of the cathode elements in a pattern, the ionized gas can be made to move from element to element, in a manner to be hereinafter described, in order to accomplish the two dimensional gas scanning objectives of the present invention. As will become apparent, it is necessary that adjacent the keep-alive element 104, an initiator element 108 be placed in spaced relationship to provide the required control.

Disposed along one edge of backing plate 102, beginning at initiator element 108, a plurality of first cathode elements are disposed in substantially parallel spaced relationship. These elements, for convenience to be referred to as vertical or Y direction elements, are labeled 110, 112, 114, 116, 118, 120, 122, and 124 respectively. Vertical elements 110–124 are connected to a vertical scan signal generator 26 capable of applying an electrical potential as hereinbefore described to vertical elements 110–124 in sequence. While, for purposes of illustration, vertical scan generator 126 is shown connected using three wires, there could, in principle, be any number of connecting lines from three up to and including the number of vertical elements employed. The specific design of vertical scan signal generator 126 and the method of connecting it to vertical elements 110–124 in order to create the sequential gas discharge scan herein described, can be according to techniques well known to those skilled in the art and form no part of the present invention.

A plurality of second cathode elements, being X direction or horizontal elements 128, 130, 132, 134, 136, 138, and 140, are disposed in parallel spaced relationship generally orthogonal to vertical elements 110–124 over the remaining area of backing plate 102 in the manner shown in FIG. 2*a*. X direction elements 128–140 are connected to a horizontal scan signal generator 142 in a manner similar to that in which Y direction elements 110–124 are connected to vertical scan signal generator 126. Initiator element 108 is connected to an initiate signal generator 144 having substantially identical electrical potential with vertical scan signal generator 126 and horizontal scan signal generator 142, previously described.

As thus configured, cathode assembly 100 is divided into eight vertical columns. The first vertical column comprises vertical elements 110–124 in conjunction with initiator element 108. Columns 2–8 comprise horizontal elements 128–140. The eight vertical elements 110–124, in conjunction with the eight vertical columns described above, give a potential of 64 (eight times eight) discrete areas for ionization of adjacent gas over the surface of cathode assembly 100. The 64 area assembly illustrated was chosen for convenience in description of the preferred embodiment only. Cathode assembly 100 could be divided into any number of rows N and columns M to provide an N by M matrix as best suits the needs of the particular application. The specific operation of cathode assembly 100 will be discussed hereinafter following the description of the unique insulating spacer desired for the operation thereof.

Figure 2B:
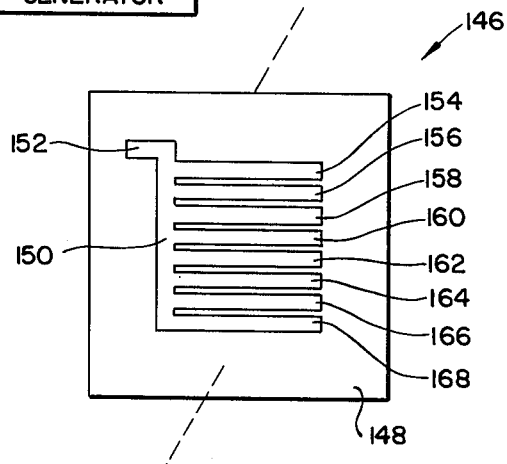

Referring now to FIG. 2*b*, insulating spacer 146 is shown as comprising a plate of insulating material 148 having a plurality of interconnected channels disposed therein. While for purposes of the disclosure spacer 146 is shown and described as being a "plate" of insulating material (and in fact could be such), in the preferred embodiment insulating spacer 146 is formed by silk screening or the like of a dielectric material directly on the cathode elements and backing plate. A first vertical channel 150 is disposed in coincidence with the first column described above. One end of vertical column 150 is connected to the space above initiator element 108 and keep-alive element 104. When insulating spacer 146 is assembled adjacent (or screened on) cathode assembly 100, and vertical channel 150 and iniator channel 152 are filled with an ionizable gas, the ionized gas adjacent keep-alive element 104 can be made to move to initiator element 108, and thence to vertical elements 110–124 in sequence along initiator channel 152 and then vertical channel 150 by sequentially applying and removing the previously described electrical potential thereto. In this manner, a vertical scan of ionized gas can be created. A plurality of horizontal channels 154, 156, 158, 160, 162, 164, 166, and 168 are disposed in parallel spaced relationship connecting at one end to vertical channel 150 and extending orthogonally therefrom across horizontal elements 128–140.

Figure 3:
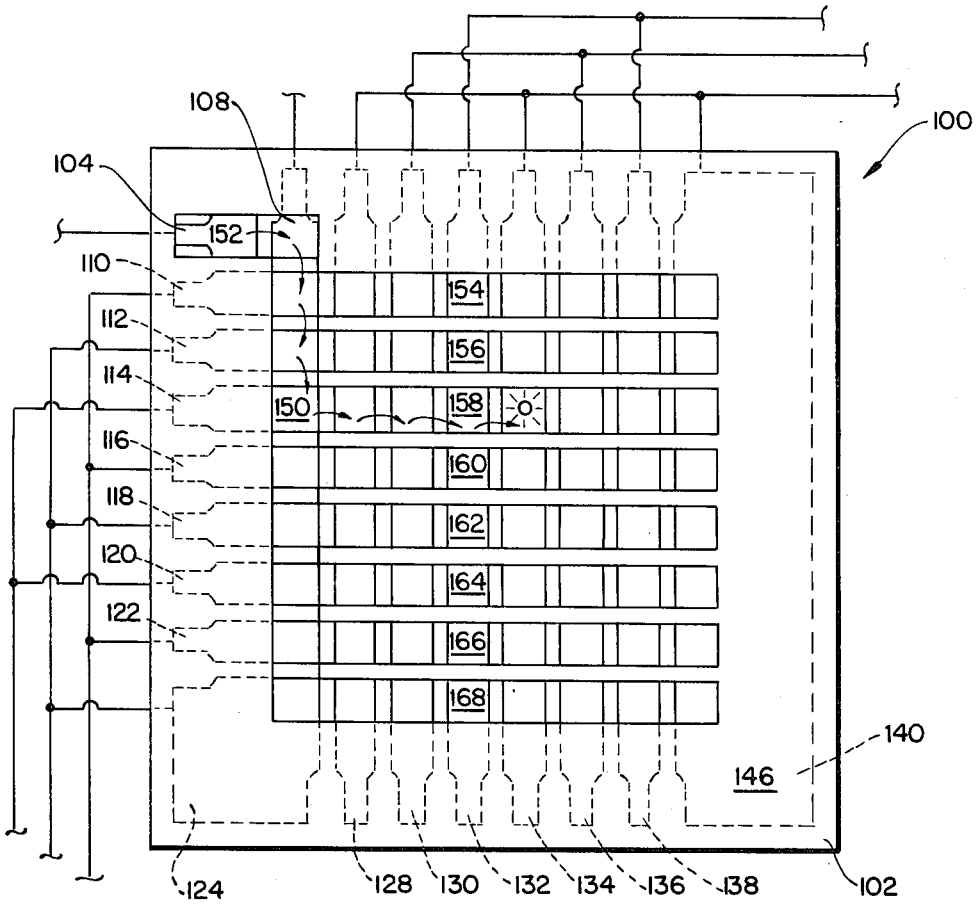
FIG. 3 is a top view of the cathode elements and insulating spacer of the present invention in their assembled state.

In operation, to provide an ionized gas discharge at a particular area on the surface of cathode assembly 100, the ionized gas is made to scan down vertical elements 110–124 to the desired vertical coordinate and thence scan horizontally in a similar manner across horizontal elements 128–140 in the appropriate horizontal channel 154–168 until the desired horizontal coordinate is achieved. By way of example, initiate signal generator 144 first applies an electrical potential to initiator element 108. This causes the ionized gas always present adjacent keep-alive element 104 to assist the gas adjacent initiator element 108 to become quickly ionized. In a similar manner, vertical scan signal generator 126, by applying an electrical potential to vertical elements 110, 116 and 122, can cause the ionized condition to move from initiator element 108 to vertical element 110 (because of the pre-ionized condition at element 108). In like manner, the ionized gas can then be made to move to vertical element 112 and thence to vertical element 114 by applying a potential to elements 112, 118 and 122 simultaneously and then elements 114 and 120. Assuming vertical element 114 represents the vertical level at which an ionized area is desired on the cathode assembly 100, further vertical movement of the ionized gas along vertical elements 110–124 is then stopped. Horizontal scan signal generator 142 is then made to apply an electrical potential to horizontal elements 128, 134 and 140. At that point in time, the ionized layer of gas exists only at keep-alive element 104 and at vertical element 114. As the ionized gas is caused to move from one vertical element to the next, the electrical potential is removed from the previous vertical element group whereby the ionized layer only exists adjacent one vertical element 110–124 at a time. In the example developed to this point, therefore, the scanning ionized gas exists only adjacent vertical element 114 at the opening to horizontal channel 158. As the electrical potential is applied to horizontal elements 128, 134 and 140, the ionized gas moves from vertical element 114 to horizontal element 128 in that portion existing within the confines of horizontal channel 158. The ionized gas is prevented from moving to that portion of horizontal element 128 within horizontal channels 156 or 160 by the portions of insulating spacer 148 separating horizontal channel 158 from horizontal channels 156, 160. By then applying the electrical potential to horizontal elements 130 and 136, horizontal scan signal generator 142 can cause the ionized gas to move down horizontal channel 158 from horizontal element 128 to horizontal element 130. In a like manner, the horizontal movement of ionized gas can be made to continue down horizontal channel 158 from horizontal element 130 to horizontal element 132, 134, etc. Assuming, for purposes of the example, that horizontal element 134 represents the desired horizontal position for the ionized gas layer on cathode assembly 100, upon reaching that position, horizontal scan signal generator 142 maintains the electrical potential at horizontal element 134 to keep the ionized gas at that location. The ionized gas can then be drawn along a gas conductive channel connected adjacent that area of cathode assembly 100 in a conventional manner for multi-layer panels, or activated in an appropriate manner for a single layer panel in order to cause the desired display on the face of the gas discharge display panel. The preceding description can best be understood with reference to FIG. 3 wherein cathode assembly 100 and insulating spacer 146 are shown in assembled superimposed relationship and the movement of the ionized gas from keep-alive element 104 to the intersection of vertical element 114 and horizontal element 134 is shown by the arrows.

Figure 2C:
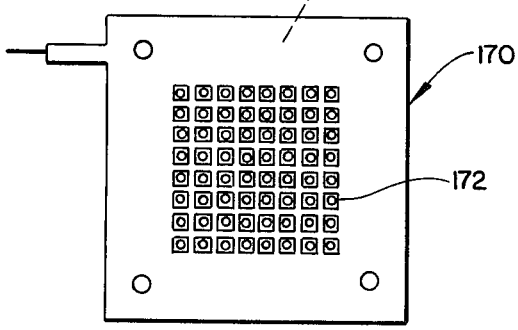
Figure 4:
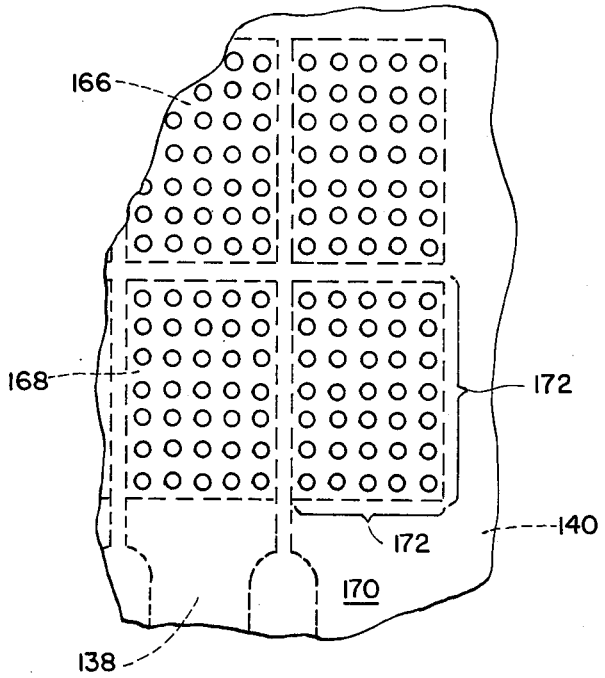
FIG. 4 is a partial view of an assembled anode plate, cathode assembly, and insulating spacer according to the present invention showing the details thereof.

The complete improved scanning cathode which comprises the present invention is composed of the cathode assembly 100 and the insulating spacer 146. The cathode must be used in conjunction with an anode. One configuration would be to use an anode electrode plate as shown in FIG. 2c. The electrical potentials applied to the cathode elements of cathode assembly 100 are made with respect to the anode plate generally indicated as 170 in FIG. 2c. Anode plate 170 comprises an electrically conductive plate or film optionally having apertures therein if necessary to the application. The apertures if used are grouped into aperture areas 172, being those apertures contained in a space defined by the area of coincidence between horizontal channels 154–168 and vertical elements 110–124 or horizontal elements 128–140. That is, in the example above comprising an 8 by 8 matrix, there would be 64 aperture areas 172. While aperture areas could be constructed to contain only one aperture per aperture area 172, such an arrangement would make little sense for incorporation within apparatus such as that of FIG. 1 or the like but could well be applicable to other uses. An aperture area containing one aperture would eliminate the need for the addressing circuitry 51, as the selection of the desired aperture area would, by definition, select the single gas conductive channel from the aperture in the reservoir to the display screen. By way of example of a configuration that might be well employed, in FIG. 4, the anode plate 170 of FIG. 6c is shown in a partial expanded view wherein the extreme lower righthand corner is shown having the aperture areas 1172 cover an area five apertures by seven apertures, or one character area. By incorporating such a two-dimensional scanning cathode in a large display panel comprising N rows and M columns of 5 × 7 character matrix positions, each character position can be individually activated with only seven connections in addition to the eight addressing connections to the scanning cathode.

Figure 5:
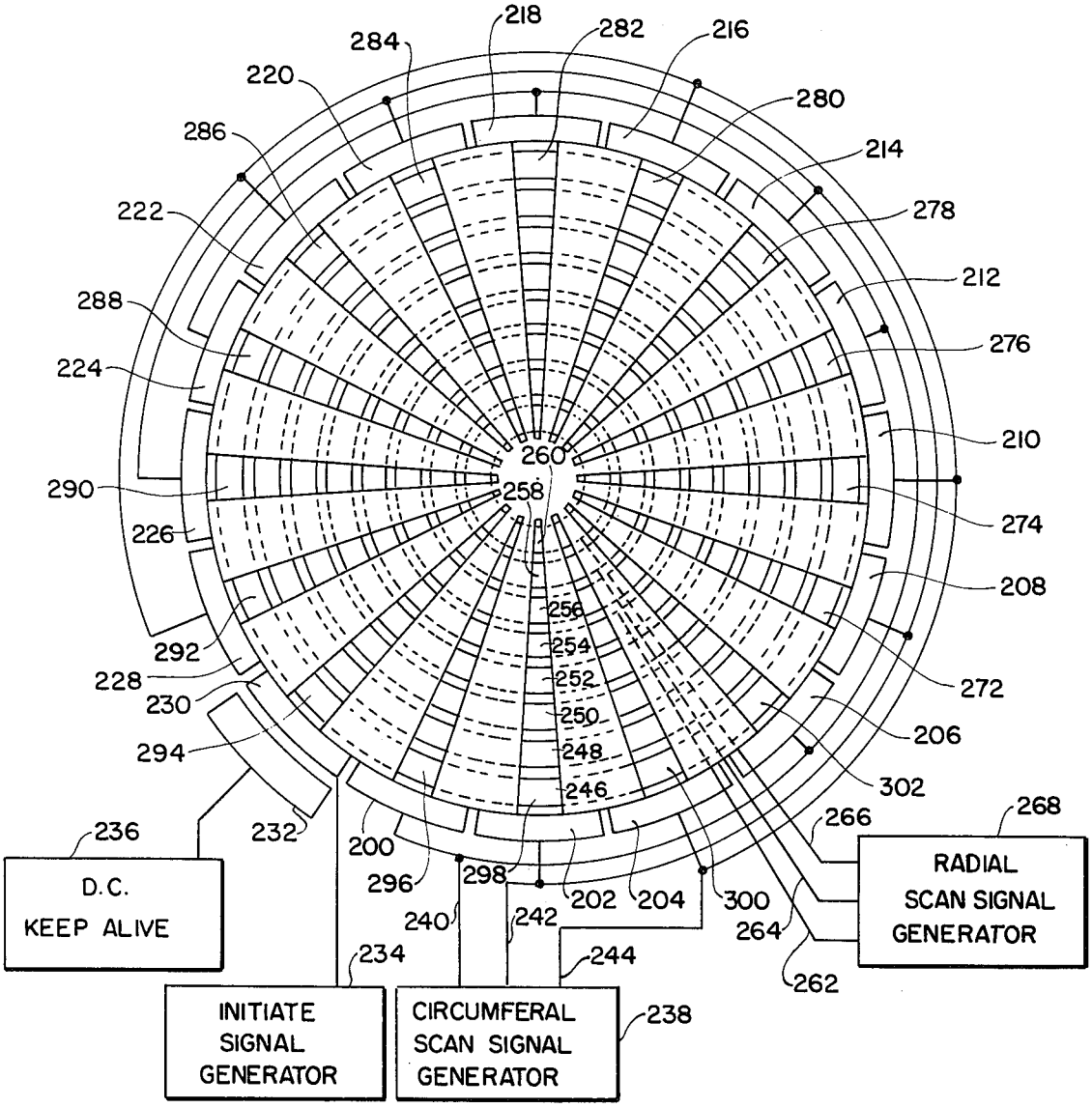
FIG. 5 is a top view of the cathode elements and insulating spacer of the present invention in their assembled state in an alternate embodiment.

The scope of the improvement of the present invention is not limited to scanning in horizontal and vertical directions or in straight lines as disclosed in the embodiment hereinbefore described. With reference to FIG. 5, an alternate embodiment is shown wherein a circumferal and radial scan combination are employed. The cathode of FIG. 5 would be particularly well suited to the construction of a gas discharge display of a conventional clock having "hands" or in a direction tracking display apparatus such as used in aircraft, aboard ship, or the like.

FIG. 5 shows an insulating spacer (or layer, if screened) adapted for the particular embodiment superimposed over the cathode elements in assembled relationship. First cathode elements 200, 202, 204, 206, 208, 210, 212, 214, 216, 218, 220, 222, 224, 226 and 228 are disposed circumferally in spaced relationship about a circular area. An initiator element 230 is disposed between cathode elements 200 and 228 to complete the circle. A keep-alive element 232 is provided adjacent initiator element 230. Initiator element 230 and keep-alive element 232 are connected to an initiate signal generator 234 and a keep-alive generator 236, respectively, and operate in a manner as described with reference to the preceding embodiment. First cathode elements 200–228 are connected to a circumferal scan signal generator 238 in the same manner as first cathode elements 110–124 were connected to vertical scan signal generator 126 in the preceding embodiment, whereby a gas discharge can be scanned from keep-alive element 232 to initiator element 230 and thence to first cathode elements 200, 202, 204, etc., by alternately applying and removing the potential from the three lines 240, 242, and 244 connecting circumferal scan signal generator 238 to first elements 200–228.

In this embodiment, the second cathode elements 246, 248, 250, 252, 254, 256, 258 and 260 are concentric circles disposed in spaced relationship inside the circle formed by first cathode elements 200–228. Second cathode elements 246–260 are connected by lines 262, 264, and 266 to radial scan signal generator 268 in the same manner as second elements 128–140 were connected to horizontal scan signal generator 142 in the preceding embodiment. In this manner, a potential can be sequentially applied to second elements 246–260 by radial scan signal generator 268.

A radially spoked insulating layer or spacer 270 is used in this embodiment to create a series of radial channels 272, 274, 276, 278, 280, 282, 284, 286, 288, 290, 292, 294, 296, 298, 300, and 302.

In its simplest form, the cathode elements 200–230 and 246–260 along with spacer 270 can be assembled adjacent a transparent conductive anode in a sealed enclosure filled with an ionizable gas (not shown) to form a single layer display. One or more illuminated radial displays can be created by activating the anode and moving a gas discharge circumferally as, for example, from electrode element 232, to 230, to 200, to 202 and thence down channel 298 to element 246, to 248, etc., and finally to element 260 in a strobing fashion. In such an application, it would be preferred to mask first elements 200–228 along with keep-alive element 232 and initiator element 230, from view by an observer so that only the radially strobed pattern(s) (such as, for example, representing the hands of a clock) would be visible.

Figure 6:
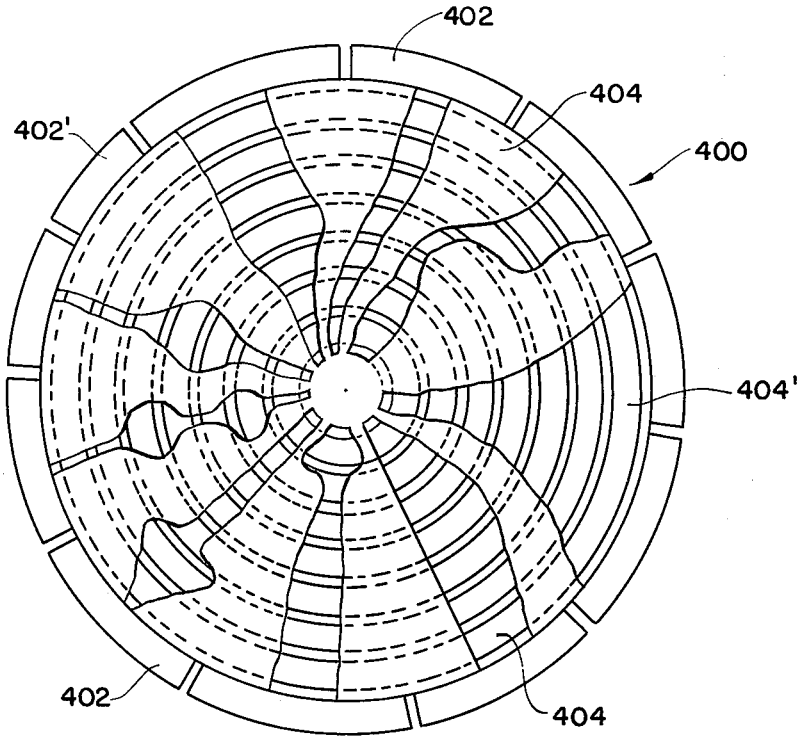
FIG. 6 is a top view of the cathode elements and insulating spacer of the present invention showing possible variations in element and spacer design.

In addition to the variations possible in the two directions of scanning as demonstrated by the foregoing examples, it should be realized that the shape of the channels in the insulating layer or spacer can be modified to give varying patterns of gas discharge movement in the second direction. That is, the second direction need not be straight or even definite. In the first embodiment described, the channels 154–168 were straight and parallel. In the second embodiment, the channels 272–302 were equally spaced radially, wedge shaped, and disposed along straight radial axes. FIG. 6 shows a combination of channel shapes representative of variations possible within the scope of the present invention. It should be noted that in the cathode and spacer assembly 400 shown, the first cathode elements 402 are not of the same length nor disposed one per channel 404. For purposes of stepping the gas discharge an uneven distance in equal time increments for a particular application, it might be advantageous to use an intermediate element such as 402' or two elements per channel as with channel 404'.

Having thus described my invention, I claim:

1. An improved cathode assembly for providing a two dimensional scan in gas discharge display apparatus comprising:

a. a plurality of first cathode elements disposed end to end in close adjacent spaced relationship along a first path;

b. a plurality of second cathode elements disposed side by side in parallel spaced relationship adjacent one side of said first path of said first cathode elements;

c. a plurality of insulating spacers disposed on said second cathode elements, said spacers each extending from between adjacent ones of said first cathode elements across said plurality of second cathode elements to form a plurality of channels from said first cathode elements across said second cathode elements;

d. means for causing an ionizable gas adjacent one of said first cathode elements to ionize;

e. first scan signal generator means operably connected to said first cathode elements for sequentially applying an electrical potential to said first cathode elements to cause the ionization to move from adjacent said one of said first cathode elements to the next adjacent of said first elements and thence to the next adjacent of said first elements seriatim until the ionized gas is disposed adjacent a selected one of said first cathode elements;

f. second scan signal generator means operably connected to said second cathode elements for sequentially applying an electrical potential to said second cathode elements to cause the ionization to move from adjacent said selected one of said first cathode elements to the portion of the next adjacent of said second cathode elements disposed within one of said channels and thence to the next adjacent of said second cathode elements within said channel seriatim until the ionized gas is disposed adjacent a selected one of said second cathode elements.

2. The improved cathode assembly of claim 1 wherein:

said plurality of spacers is comprised of a dielectric material deposited directly onto said second cathode elements.

3. The improved cathode assembly of claim 1 wherein:

a. said first path is a straight line; and, b. said channels form straight lines orthogonal to said first path.

4. The improved cathode assembly of claim 1 wherein:

a. said first path is circular;

b. said second electrodes are disposed on circles concentric to said first path; and, c. said channels are disposed along radii of said concentric circles.

5. An improved cathode assembly for providing a two dimensional scan in gas discharge display apparatus comprising:

a. a substrate;

b. a plurality of first cathode elements disposed on said substrate in close adjacent spaced relationship along a first path;

c. a plurality of second cathode elements disposed on said substrate, each of said second cathode elements being disposed along the length of ones of a plurality of second paths parallel to said first path, said second cathode elements being in close adjacent spaced relationship to each other;

d. an insulating material disposed on said first cathode elements, said second cathode elements and said substrate and having channels therein for containing an ionizable gas, said channels extending from adjacent ones of said first cathode elements across said second cathode elements;

c. means for causing an ionizable gas adjacent one of said first cathode elements to ionize;

f. first scan signal generator means operably connected to said first cathode elements for sequentially applying an electrical potential to said first cathode elements to cause the ionization to move from adjacent said one of said first cathode elements to the next adjacent of said first elements and thence to the next adjacent of said first elements seriatim until the ionized gas is disposed adjacent a selected one of said first cathode elements;

g. second scan signal generator means operably connected to said second cathode elements for sequentially applying an electrical potential to said second cathode elements to cause the ionization to move from adjacent said selected one of said first cathode elements to the portion of the next adjacent of said second cathode elements bounded by a selected one of said channels and thence to the next adjacent of said second cathode elements bounded by said channel seriatim until the ionized gas is disposed adjacent an area on said cathode defined by said selected one of said second cathode elements bounded by said selected channel.

6. The improved cathode assembly of claim 5 wherein:

said first and second paths form concentric circles and said channels lie along radii of said circles.

7. The improved cathode assembly of claim 5 wherein:

said first and second paths are parallel straight lines and said channels are disposed orthogonally to said paths.

8. The method of moving an ionized gas to a selected area of a cathode assembly disposed in close spaced relationship to an anode and having an ionizable gas disposed therebetween comprising the steps of:

a. applying an electrical potential between an initiator cathode element of said cathode assembly and said anode to create an area of ionized gas at a first location;

b. applying an electrical potential in sequence to a plurality of first cathode elements of said cathode assembly to cause said ionized gas to move along said first cathode elements seriatim from said initiator cathode element to a selected one of said first cathode elements related to a first coordinate of the selected area of the cathode assembly;

c. applying an electrical potential in sequence to a plurality of second cathode elements of said cathode assembly to cause said ionized gas to move along said second cathode elements seriatim from said selected one of said first cathode elements to a selected one of said second cathode elements defining a second coordinate of the selected area of the cathode assembly; and, d. guiding said ionized gas within a channel from said selected one of said first cathode elements across said second cathode elements whereby said ionized gas will be constrained within the first coordinate bounds at said second cathode element.

* * * * *